United States Patent [19]

Halbich

[11] Patent Number: 4,793,492

[45] Date of Patent: Dec. 27, 1988

[54] HOMECARE PILLBOX

[76] Inventor: Frank Halbich, 11983 Salem Dr., Granada Hills, Calif. 91344

[21] Appl. No.: 182,780

[22] Filed: Apr. 18, 1988

Related U.S. Application Data

[63] Continuation of Ser. No. 930,445, Nov. 14, 1986, abandoned.

[51] Int. Cl.[4] ..... B65D 21/02

[52] U.S. Cl. ..... 206/538; 206/45; 206/45.11; 220/23.4

[58] Field of Search ..... 206/45, 538, 45.18, 206/45.11, 44.11; 220/23.4

[56] References Cited

U.S. PATENT DOCUMENTS

| | | | |
|---|---|---|---|
| 1,930,386 | 10/1933 | Feeback | 206/45 |
| 3,429,427 | 2/1969 | Wolf | 206/45 |
| 3,539,237 | 11/1970 | Acker | 206/44.11 |
| 3,647,105 | 3/1972 | Keeslar | 220/23.4 |
| 3,771,695 | 11/1975 | Pehr | 206/538 |
| 4,039,080 | 8/1977 | Cappuccilli | 206/538 |
| 4,318,477 | 3/1982 | Kerpe | 206/534 |
| 4,328,902 | 5/1982 | North | 220/23.4 |
| 4,387,824 | 6/1983 | Wefers | 220/23.4 |

*Primary Examiner*—Joseph Man-Fu Moy
*Attorney, Agent, or Firm*—Herzig & Yanny

[57] ABSTRACT

An improved homecare pillbox containing a plurality of compartments for pills or the like arranged, indexed and differentiated in units for use over a selected period of time such as a week, and for providing proper medication in accurate doses to patients, whether supervised or unsupervised; readily releasable means for securing together any number of such units for holding several types of medication to be taken at different times during the day; and cover means for easy opening and access and for storing and protecting medication.

8 Claims, 3 Drawing Sheets

HOMECARE PILLBOX

This is a continuation of co-pending application Ser. No. 930,445 filed on 11/14/86, now abandoned.

BACKGROUND OF THE INVENTION

1. Field of the Invention

This invention relates to improvements to pillboxes in general and to new and useful improvements in pillboxes designed for homecare with a plurality of compartments designed to simplify and improve the accuracy of unsupervised medication despensing in the home. Each homecare pillbox consists of preferably seven (7) see-through compartments with separate lids. Each compartment lid is marked preferably with a number as one (1) through seven (7) and preferably also a letter indicating the day of the week. Braille, indicating the same information, may also be embossed on each cover lid. Unsupervised patients use the pillbox to ensure that the proper medication is taken at the correct time. Where multiple doses are required the pillboxes are designed for readily releasable snap-together structure to create a single unit capable of holding several different types of medications taken at different times during the day. Different medication times may be indicated also by using various colored lids or by marking a roughened surface.

2. Brief Description of Prior Art

Background of the invention is contained in prior patents issued to the same inventor U.S. Pat. Nos. 4,084,695 issued Apr. 8, 1978, 4,253,572 issued Mar. 3, 1981 and U.S. Pat. No. 4,403,462 issued Sept. 13, 1983, all incorporated herein by this reference.

U.S. Pat. No. 4,084,695 relates to a clear plastic pillbox having an intermediate longitudinal channel and lateral partitions which form a multiplicity of compartments therein for storage and convenient dispensing of medicament tablets. The pillbox is sealed by a clear plastic cover having a plurality of slots through its surface which form peripheral seals around the projections of the lateral partitions above the side walls of the pillbox, and thus individual sealing tabs are provided for each of the compartments created by the longitudinal channel and lateral partitions. The individual sealing tabs are frangible and may be broken away to provide access to particular compartments, which may be preloaded by pharmacists with medicament tablets or doses of medication for scheduled use.

U.S. Pat. No. 4,253,572 relates to a pillbox or container wherein individual compartments can be opened by manually removing a tab having a construction such that each individual compartment becomes airtight. An integral continuous depending flange on the underside of each tab interfaces with the top of the respective compartments.

U.S. Pat. No. 4,403,462 is a divisional of the application of the preceding U.S. Pat. No. 4,253,572. It discloses, like said parent, but also claims a loading tool constructed and adapted for use with the preferred box disclosed in the parent application. The box is rectilinear, preferably covered, and having a bottom provided with a series of recesses geometrically related to the correspondent geometric relationship of the compartments in the container so that pills, capsules or tablets can be dumped into the loading appliance and then positioned by agitation in suitable places in the bottom of the appliance. By inverting the container over the aligned pills and then inverting the two together, the pills will drop into the compartments corresponding to those in the container.

Prior art deemed most relevant in the respective patents above referred to are listed therein as follows:

U.S. Pat. No. 2,001,045, 5/1935 Weiss, 53/392 X
U.S. Pat. No. 2,143,518, 1/1939 Kolin, 53,392 X
U.S. Pat. No. 2,729,375, 1/1956 Pace, 220/21 X
U.S. Pat. No. 3,034,733, 1/1976 Worden, 53/392 X
U.S. Pat. No. 4,084,695, 4/1978 Halbich, 206/601 X
U.S. Pat. No. 4,176,751, 12/1979 Gillissie, 53/392 X

OBJECTS AND SUMMARY OF THE INVENTION

A primary object of the present invention is to provide a plurality of pill containing compartments arranged in a symmetrical manner and indexed and differentiated for use over a selected period of time such as a week for daily use of the individual compartments respectively at a customarily predetermined time. Having done so, it is a further primary object of this invention to provide appropriate means for securing together in a desired order and arrangement any number of such series of, for example, weekly dispensers with one or more other weekly dispensers in a new and novel arrangement which provides easy access to the individual compartments so that, for example, a pill in one series may be designated for use in the morning and the pills in a connected series may be designated for use at another time such as in the afternoon, and another may be connected thereto for use in the evening or at any other hour and so on.

It is a further object of the invention to provide new and improved cover means for filling the individual compartments with one or more different types of medications to be taken at different times during the day, and thereafter to provide for facile opening thereof and access thereto.

It is a further object of the invention to provide a logical well-organized structure and means for segregating medication into discrete moieties for the orderly and accurate dispensing of medication in a manner to provide optimum medication with great accuracy and reliability with respect to the dosage and the time thereof coupled with a visible and manual means of checking off with assurance those dosages which have been taken and those which remain to be taken in time ordered manner and sequence.

It is a general object of the invention to provide means and method to assure proper medication to unsupervised patients to overcome the all-too-frequent forgetfulness and confusion of unsupervised patients as well to similarly assist and guard against corresponding frailties of nurses and others seeking to assist them.

With the above and other objects in view this invention resides in the novel features of form, construction, arrangement, and combination of parts illustrated and described and as pointed out in the claims.

BRIEF DESCRIPTION OF THE DRAWINGS

Figure 1:
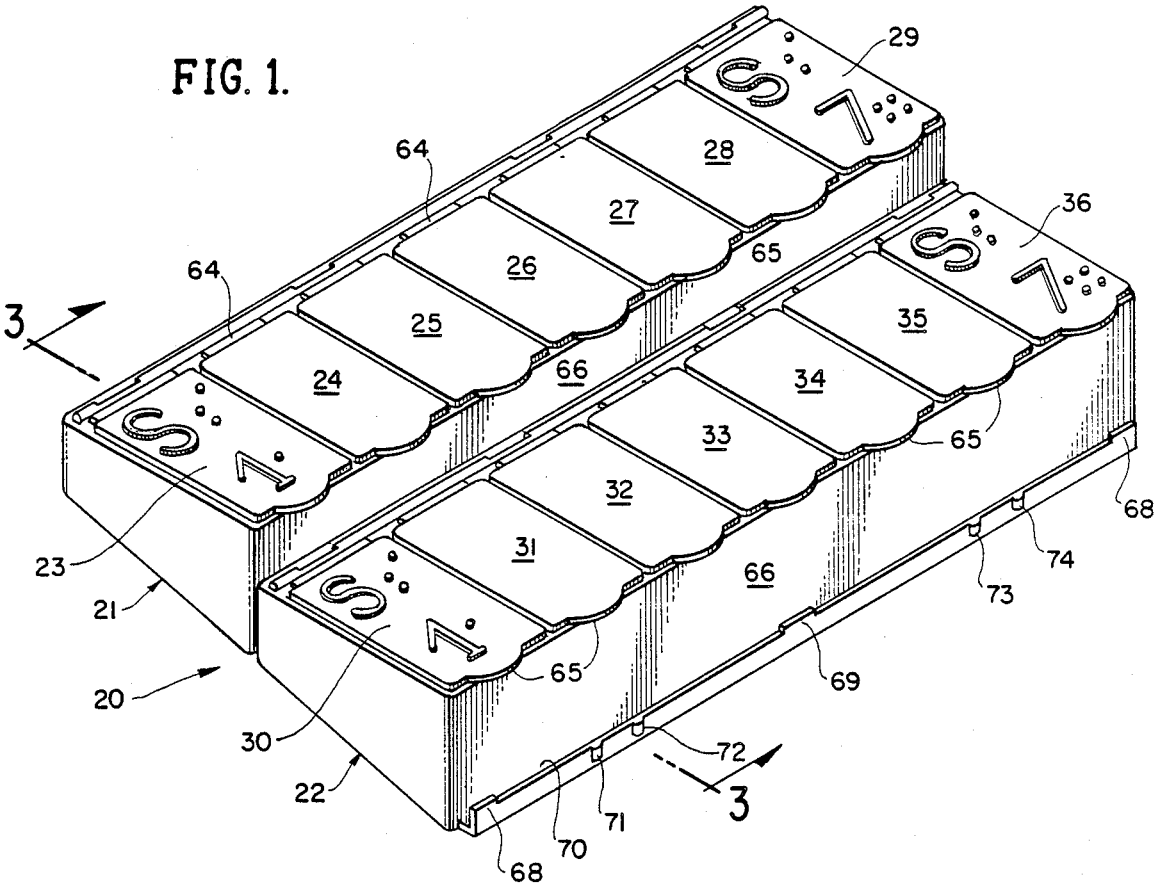

Having thus described the invention and the objects thereof in general terms reference is now made to the accompanying drawings in which:

FIG. 1 is an isometric view of a compartmentalized dispenser embodying this invention.

Figure 2:
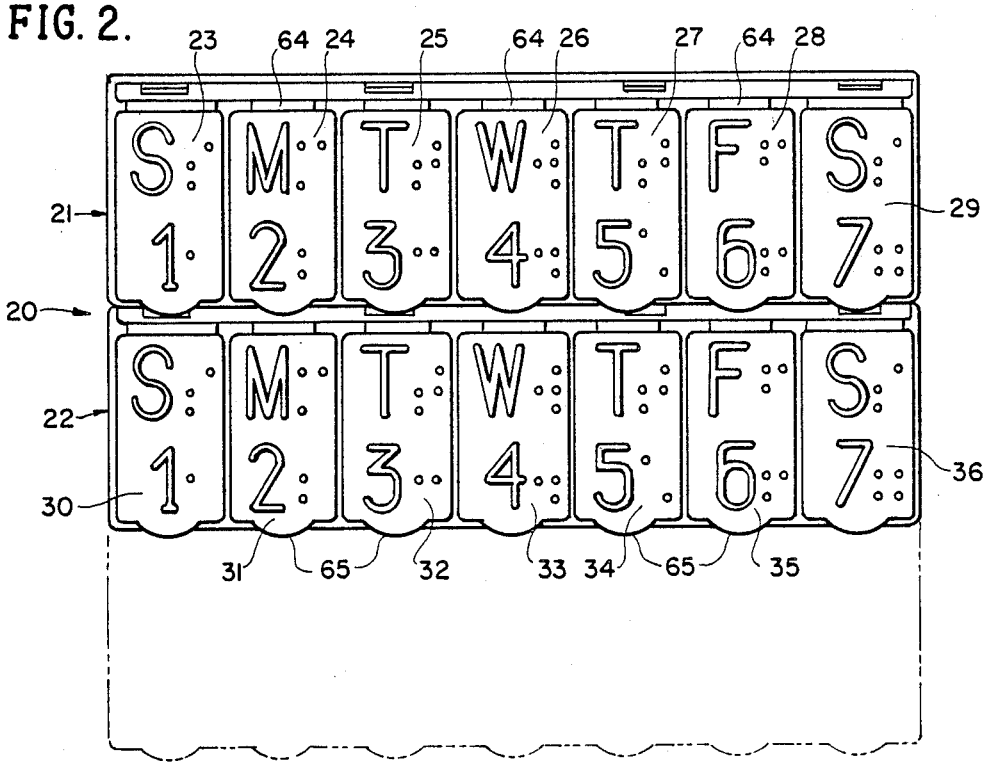

FIG. 2 is top view of FIG. 1.

Figure 3:
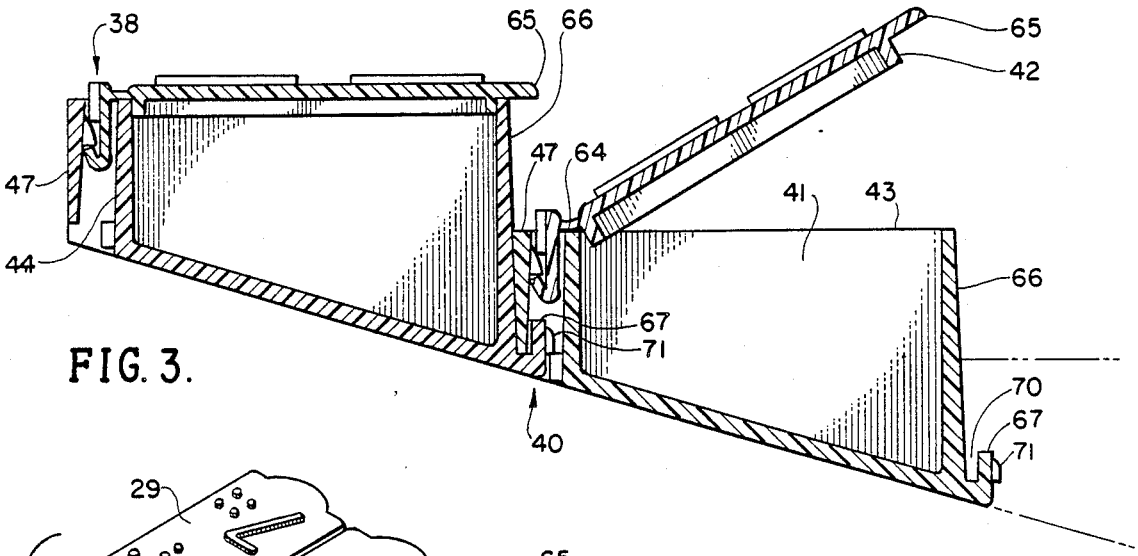

FIG. 3 is a vertical sectional view taken on the line 3—3 of FIG. 1.

Figure 4:
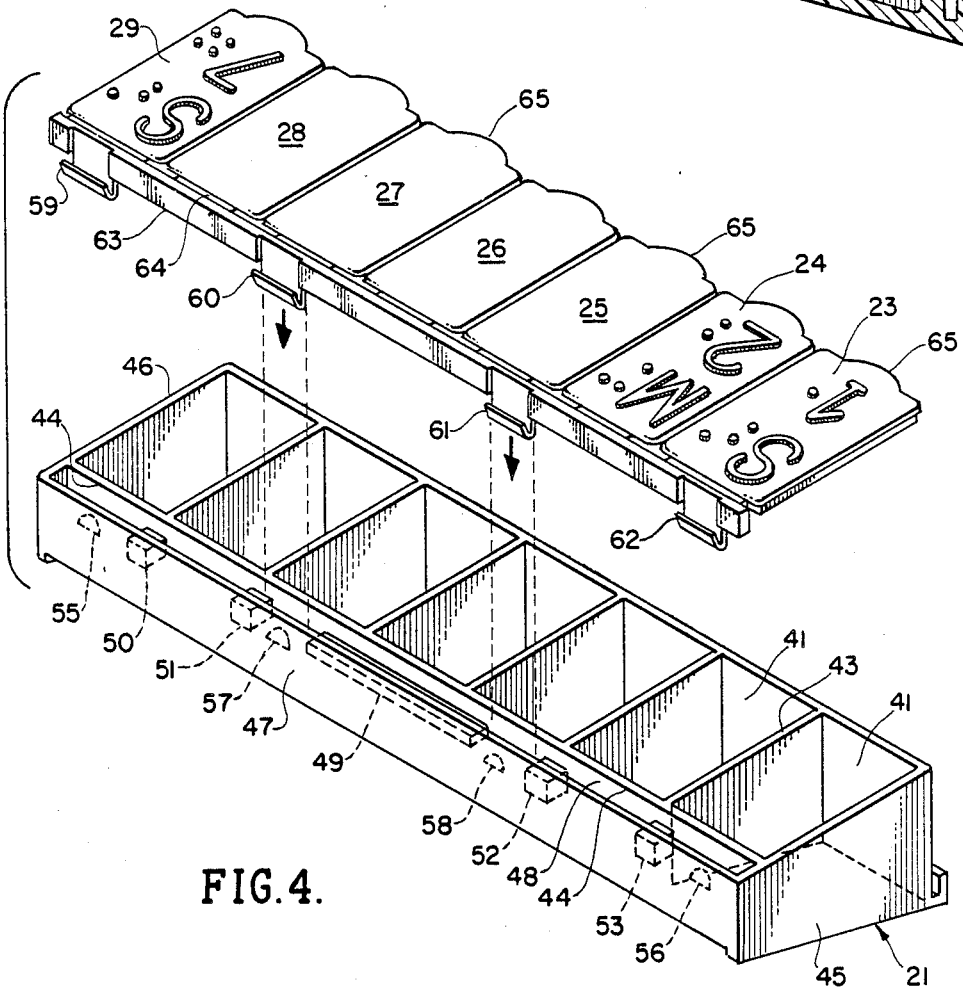

FIG. 4 is an exploded view of a compartmented segment illustrating the mode of connection between the top and body thereof.

Figure 5:
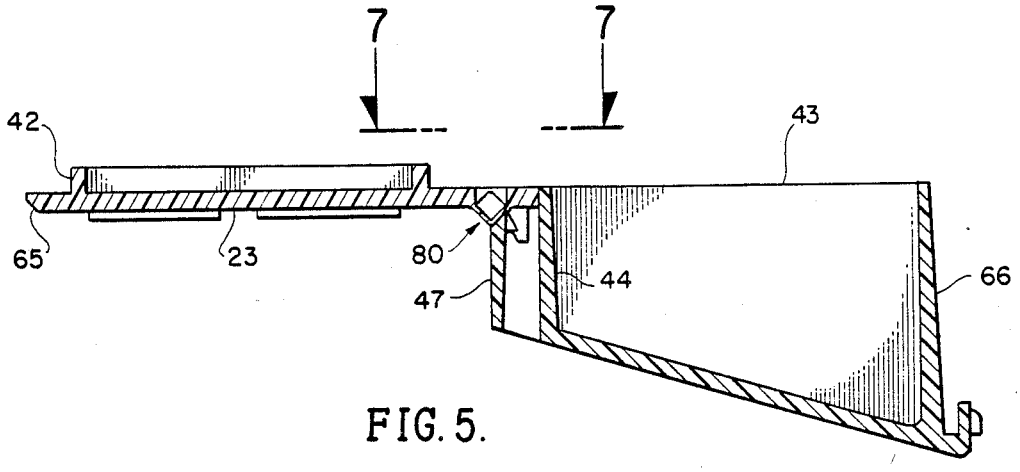

FIG. 5 is a second preferred embodiment of a lid construction in open position.

Figure 6:
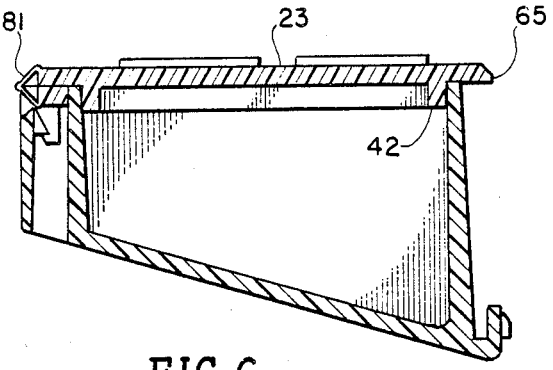

FIG. 6 is a vertical elevational view similar to FIG. 5 but showing the lid in closed position.

Figure 7:
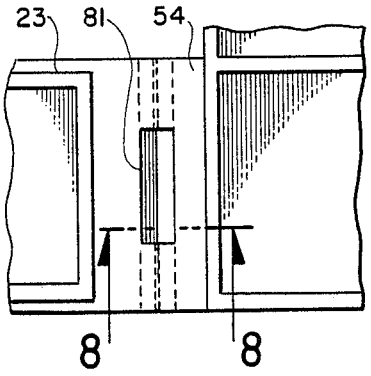

FIG. 7 is a vertical view on the lines 7—7 of FIG. 5.

Figure 8:
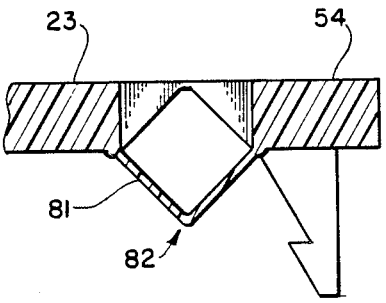

FIG. 8 is a sectional view on the lines 8—8 of FIG. 7 showing the arrangement of the lid interconnection in open position.

Figure 9:
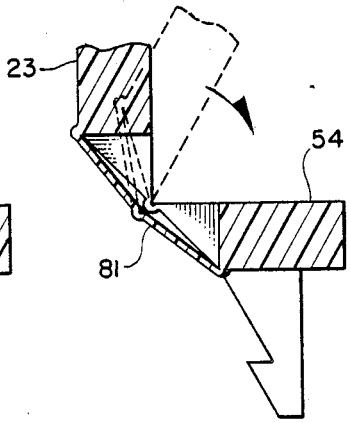

FIG. 9 is a similar view to FIG. 8 showing the lid in a mid-position, fully opened, and fully closed.

Figure 10:
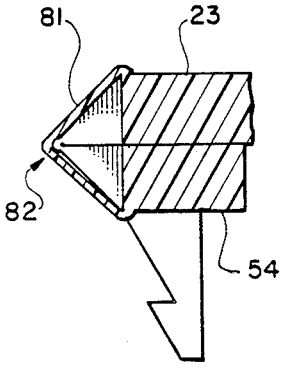

FIG. 10 is a similar view to FIGS. 8 and 9 showing the lid in closed position.

DETAILED DESCRIPTION OF A PREFERRED EMBODIMENT

Referring now in more detail and by reference characters to the drawings which illustrate a preferred embodiment of the invention, the reference numeral 20 designates a dispenser which may comprise only one component 21 or 22 or any number of any such components, preferably releasably secured as by means of a releasable securement by which the components or any number of them may be releasably secured together with any degree of permanence and with any desired degree of facility of separation as will be described. It is preferable however that they be secured together with sufficient strength so that they will remain connected even in the event of an accidental dropping of the pillboxes by user and that they also remain closed during such an accident. To that end, the lids 23 through 36 are secured together and to the bodies of the pillboxes by lid securement means 38 and the boxes secured together by a releasable securement 40 (see FIG. 3). The lids are also individually secured in closed position by snug fit and by which the individual compartments 41 are made airtight. Circumferentially integral flanges 42 are therefor provided to nest in and pressingly fit against the inner walls of the respective corresponding pill compartments 41 at and adjacent their top edges 43.

The pillboxes are preferably formed and integrally molded from plastic and the lids are similarly so formed and molded together and as a separate assembly which is thereafter pressed together in a permanent usable fashion by the lid securement means 38 (see FIG. 4).

To provide such securement the body of the box at its rear wall 44 at its side walls 45 and 46 are extended rearwardly to form, with a rear flange 47, a rear recess 48. The rear flange 47 is reinforced in said spaced relation from the rear wall by means of an elongate cross-integral with the rear wall 44 and the rear flange 47 to retain said space relationship by an elongate reinforcement 49 and other spaced bosses 50, 51, 52 and 53 all of which are preferably molded together with the body of the pillbox as an integral molded portion thereof for simplicity and economy of manufacturer. Detents at 55 and 56 on the inner surface of the rear wall 44 and at 57 and 58 are adapted to receive and confine the shaped ends 59, 60, 61 and 62 which are designed to be accommodated in the recess 48 provided by the back flange 47 where they are snapfit against and form a confinement with the respective detents 55, 56, 57 and 58. Said hooks depend from respective downward extensions of cover bar 63 which they are integral and on which the lids 23 through 29 are secured and hinged at 64 and preferably integrally with said bar 63 and said lids as a living hinge of a suitable plastic such as polypropylene.

The lids are marked appropriately with numerals 1, 2, 3, 4, 5, 6 and 7 corresponding to the number of days in a week and are marked with letters S, M, T, W, T, F and S corresponding to the days in the week. They are also preferably embossed with braille indicating the same information all as clearly appears in the drawings (see FIG. 2).

When the lids are pressed upon and secured to the bodies 54 the pillbox is complete. The lids are respectively individually openable by lifting the lid at its forward edge 65 at which position it is provided with a lift tab 65 by which the respective lids are hingably opened.

The front wall 66 of the pillbox is of greater height—approximately twice the height—as compared to the height of the rear wall 44, and the side walls 45 and 46 of the pillbox 21 for example is tapered to accomodate that difference in height.

Accordingly, if two (2) pillboxes are to be connected together the front wall of the pillbox 21 is intended to and does extend above the adjacent rear wall of the second pillbox 22 with which it abuts. The second pillbox is held in such relationship by means of said releasable securement 40. Thereby the lids can be readily accessed and conveniently lifted by means of their tabs 65 which are thereby vertically spaced above the rear wall of the front pillbox 22. The front pillbox 22 is also easily accessed in similar fashion by lifting up the tabs 65.

It will be noted that both pillboxes 21 and 22 are readily accessible and visible from their front side when supported on a flat surface for storage or use. It is also to be noted that if the morning's supply of pills has been emptied on the first day of the week, Sunday, the lid may be left open on that compartment and the second dosage of pills will be available on the other of the two pillboxes 21 or 22 on that date. Similarly any number of pillboxes may be releasably secured together front to back for the third or other dose at a time specified and prescribed by the doctor.

Any visible surface on the sides or on the front of the pillboxes may be roughened or surfaced in a manner to permit any other information to be written thereon such as the time, the date, or other instructions, and space may be allotted on the lid or the body of the pillbox for that purpose. It is preferable that the tops be opaque and colored and the bodies transparent or translucent.

Said means of securement of the pillboxes together are the upturned lip on the front of the pillbox extends approximately one-eighth inch ($\frac{1}{8}''$) in height on the inside between itself and the front wall 66. On the lip are three lugs standing above the lip itself 67 in the center and, 69 and 68, respectively in the opposite ends. These are tapered at the top by having the tapered lug when they engage the next unit to make connect first with the slot. The rest of the lip would follow the lugs in front. By having the lugs in the places where they are, it makes it possible to distort the back wall of the recess of the slot 70. As soon as these lugs or bumps override the two tabs on the inside of the slot, the lugs will be relieved and so will the outer wall because there is a detent connection between them.

The width of the recess or slot 70 is equal to the width of thickness of the lid including the approximately 0.040" height of the dimple. Without those protrusions or dimples the lips would not retain the two (2) or more pillboxes together with the desired strength. In order to achieve the desired degree of interference fit the dimples 71, 72, 73 and 74 are in spaced pairs as shown in FIGS. 1 and 3 and extend forwardly approximately 0.040" from the front surface of the upturned lid lip lug 67 they are approximately one-sixteenth inch (1/16") wide with a full radius at their top and as shown most clearly in FIG. 3. With the structure as described and illustrated and with the lid and its integral structures including the cover bar 63 and its parts made of Tenite 5310A by Eastman Kodak and the body 54 of the pillbox and its parts made of a modified acrylic DR 100 from Rohm and Haas an optimum degree of releasable securement between the pillboxes is achieved at the releasable securement 40.

In order to put the two (2) or more pillboxes together the rear most container is placed on a flat surface with the numbers facing forward. The second container is placed back to front against the first container to engage the slots in a releasable securement. Then the front container is pressed down at its rear edge firmly until the parts lock. When they are properly joined in this fashion the bottom surface of the boxes will lie on the same flat plane.

In use a single pillbox divided in seven compartments, one for each day of the week, is capable of holding several different types of medications such as pills, capsules, tablets and like constituting for example the first dose. If such dose is to be repeated daily thereafter it may be placed in the other compartments corresponding to the use date and time. If a second dose is to be given on the same date a second pillbox may be releasably secured to the first one as by placing the first pillbox on a flat surface and interfitting and pressing down and snapping the second pillbox with the first by virtue of the releasable securement above described. For additional doses on the same day additional pillboxes are similarly connected. Medications for a subsequent day are deposited in the corresponding compartments by first opening the lids and then pressing them closed and thereby securely and safely retaining them for use at the prescribed time and in the prescribed amount. To remove one pillbox from another they are forced apart to disengage interfitting flanges and recesses 40. Thereby the objects of the invention are achieved.

Now having reference to the second preferred embodiment, corresponding parts are designated by like reference numerals. The living hinge construction has been modified to incorporate a snap-over hinge wherein the body 81 of the hinge may be integral with the body 54 of the pillbox on one side and the lids 23 through 36 on the other side. The body 81 has an elastic memory and is cast and molded at an angle of approximately 90 degrees (90°) as shown at 82 in FIG. 8. When the lid is fully opened as shown in FIGS. 5 and 8, the body 81 of the hinge including the angle 82 is unstressed. It is similarly unstressed in closed position of the lid as shown in FIGS. 6 and 10. In any intermediate posture, the body 81 is in tension, as illustrated in FIG. 9, and seeks to restore itself to its unstressed position either in a fully opened or fully closed position. The hinge's tendency is to urge the lid into a fully opened or fully closed position. Thereby the lid is kept open as fully as possible when the corresponding compartment is opened and holds the lid in a closed position when the lid is closed down and pressed into place.

Thus there has been illustrated and described a unique and novel pillbox construction which is highly effective to accomplish the purposes intended and provide a foolproof achievement of a highly important medication-taking routine. It may be expanded or trimmed to suit any medication taking requirements. It may be utilized and constructed to monitor a weekly, daily, monthly or other routine within the skill of the art.

Thus the described invention fulfills all of the objects and advantages which have been sought. It should be understood that changes, modifications, variations and other uses and applications of the disclosed invention will become apparent to those skilled in the art after considering the specifications and accompanying drawings. Therefor any and all such changes, modifications, variations and other used and applications which do not depart from the spirit and scope of the invention are deemed to be covered by the invention.

I claim:

1. A pillbox means including a box having the plurality of separate compartments for receiving pills and cover means therefor for individually closing respective pill compartments, said pillbox having a rear wall and a front wall taller than the rear wall, connecting means for connecting a plurality of said pillboxes together in front to back relationship wherein the cover means of the boxes so connected are disposed in non-coplanar relationship so as to present a stepped appearance affording access to each of the pillboxes from the front and means for opening the covers on their respective pill compartments.

2. A pillbox construction as defined in claim 1 and wherein the said pillbox has sidewall means tapered downwardly from front to rear and having a flat bottom means for resting on a surface, and a said connecting means being constructed and arranged to secure and retain pillboxes both individually and conjointly parallel to the supporting surface.

3. The pillboxes of claim 1, having flat bottoms and constructed and arranged together with said connecting means to lie in a common plane parallel to said supporting surface.

4. The pillboxes of claim 1, said connecting means being constructed and arranged to be releasable for connecting said pillboxes together for release and securement manually with predetermined force.

5. The pillbox of claim 1, wherein said individual covers include hinge means operative from the rear of the containers for retaining the covers in biased open and biased closed positions at the option of the user.

6. The pillbox of claim 1, and having handle means accessible from the front for the opening of the covers, and sealing means operative for closing the covers for providing an airtight seal for the containers respectively.

7. The pillbox of claim 1, wherein the containers are disposed in side by side relationship from side to side of the pillbox and are seven (7) in number having marking means thereon for designating the respective days of the week.

8. The pillbox of claim 1, wherein the pillboxes are constructed of see-through material and wherein the lids are colored or differentiating one box from another and include means for snapping the boxes together in front to back stepped relationships.

* * * * *